US007491318B2

(12) United States Patent
Humblot

(10) Patent No.: US 7,491,318 B2
(45) Date of Patent: Feb. 17, 2009

(54) METHOD FOR PREVENTION OF CORROSION BY NAPHTHENIC ACIDS IN REFINERIES

(75) Inventor: Francis Humblot, Lanneplaa (FR)

(73) Assignee: Arkema France, Colombes (FR)

( * ) Notice: Subject to any disclaimer, the term of this patent is extended or adjusted under 35 U.S.C. 154(b) by 238 days.

(21) Appl. No.: 10/563,549

(22) PCT Filed: Jun. 25, 2004

(86) PCT No.: PCT/FR2004/001608

§ 371 (c)(1),
(2), (4) Date: Jan. 5, 2006

(87) PCT Pub. No.: WO2005/014758

PCT Pub. Date: Feb. 17, 2005

(65) Prior Publication Data

US 2006/0157387 A1 Jul. 20, 2006

(30) Foreign Application Priority Data

Jul. 7, 2003 (FR) ..... 03 08250

(51) Int. Cl.
*C10G 17/00* (2006.01)
*C10G 17/10* (2006.01)
*C09K 3/00* (2006.01)
*C23F 11/00* (2006.01)

(52) U.S. Cl. ..... 208/255; 208/47; 252/387; 252/388; 252/389.1; 252/390; 252/391; 252/395; 422/7

(58) Field of Classification Search ..... 208/47, 208/255; 252/387, 388, 389.1, 390, 391, 252/395; 422/7; 203/7; 585/950; 502/168, 502/210, 211, 213, 219, 220, 221, 222
See application file for complete search history.

(56) References Cited

U.S. PATENT DOCUMENTS

| | | | | |
|---|---|---|---|---|
| 3,048,620 | A * | 8/1962 | Spivack | 560/37 |
| 4,981,828 | A * | 1/1991 | Takahashi et al. | 502/168 |
| 4,992,403 | A * | 2/1991 | Takahashi et al. | 502/164 |
| 5,182,013 | A | 1/1993 | Petersen et al. | |
| 5,552,085 | A | 9/1996 | Babaian-Kibala | |
| 5,853,619 | A | 12/1998 | Watson et al. | |
| 5,976,416 | A * | 11/1999 | Brezinski | 252/389.62 |
| 6,492,296 | B2 * | 12/2002 | Eijsbouts | 502/168 |

FOREIGN PATENT DOCUMENTS

| | | |
|---|---|---|
| EP | 0 742 277 | 4/1996 |
| FR | 2 774 398 | 2/1998 |
| WO | WO 97/45503 | 3/1997 |

OTHER PUBLICATIONS

Turnbull, Corrosion, vol. 54, No. 11, p. 922, 1998.

* cited by examiner

*Primary Examiner*—Walter D Griffin
*Assistant Examiner*—Huy-Tram Nguyen
(74) *Attorney, Agent, or Firm*—Steven D. Boyd

(57) ABSTRACT

The invention relates to a method for prevention of corrosion by naphthenic acids in a refinery comprising the use of a compound of the formula HS—B—COOR, where B is a saturated bivalent 1-18 C hydrocarbon and R is H, alkaline or alkaline earth metal, ammonium, straight or branched alkyl, cycloalkyl, aryl, alkylaryl or arylalkyl with 1-18 C atoms.

12 Claims, No Drawings

METHOD FOR PREVENTION OF CORROSION BY NAPHTHENIC ACIDS IN REFINERIES

FIELD OF THE INVENTION

The present invention relates to the field of the treatment of acidic crude oils in refineries. A more specific subject matter of the invention is a process for combating the corrosion of refining plants in which acidic crudes are treated, comprising the use of specific sulfur compounds.

BACKGROUND OF THE INVENTION

Oil refineries may be faced with a serious problem of corrosion when they are used to treat certain "acidic" crudes. These acidic crudes essentially comprise naphthenic acids which are the cause of this very specific corrosion phenomenon since it occurs in a liquid medium which is a nonconductor of electrical current. These naphthenic acids correspond to saturated cyclic hydrocarbons carrying one or more carboxyl groups. The acidity of a petroleum crude oil is described by a standardized measurement according to Standard ASTM D 664-01. It is expressed in mg of potassium hydroxide necessary to neutralize 1 g of oil and is referred to as TAN (Total Acid Number). It is known in this technical field that a crude oil having a TAN of greater than 0.2 is described as acidic and can result in damage in the plants of a refinery.

This corrosion reaction is highly dependent on the local conditions, such as, for example, the temperature and the metallic nature of the wall in the plant concerned, the space velocity of the hydrocarbon and the presence of a gas-liquid interface. Thus, even after considerable research on the subject, refiners encounter great difficulties in predicting the scale of the corrosion reactions and their location.

One of the industrial solutions to this corrosion problem consists in using installations made of stainless steels, i.e. alloys of iron with in particular chromium and molybdenum. However, this solution is not employed to any great extent due to the high capital cost. Furthermore, this choice preferably has to be considered during the design of the refinery as stainless steels exhibit inferior mechanical properties to those of the carbon steels which are normally used and require an appropriate infrastructure.

The existence of these technical difficulties in the treatment of acidic crudes thus has the consequence that these crudes are generally sold to refiners at a lower price level than that of standard crudes.

Another solution to the problem of the treatment of an acidic crude oil, used by refiners in practice, consists in diluting it with another nonacidic petroleum crude oil so as to obtain a low mean acidity, for example of less than the TAN threshold of 0.2. In this case, the concentration of naphthenic acid becomes sufficiently low to produce acceptable rates of corrosion. However, this solution remains of limited scope. This is because some acidic crudes exhibit TAN values of greater than 2, which places an upper limit on their use at at most 10% of the total volume of crudes entering the refinery. Moreover, some of these mixtures of crudes with acidic crude sometimes result in the opposite effect desired, that is to say in an acceleration in the reactions for corrosion by naphthenic acids.

Another approach for combating this corrosion problem is the introduction into the acidic crude oil to be treated of chemical additives which inhibit or prevent attack on the metal wall of the plant concerned. This route is often very economical in comparison with that consisting in using the special steels or alloys indicated above.

Laboratory studies, such as that of Turnbull (Corrosion—November 1998, in Corrosion, volume 54, No. 11, page 922), have envisaged the addition of small amounts (of the order of 0.1%) of hydrogen sulfide to the crude oil to reduce corrosion by naphthenic acids. However, this solution cannot be applied in a refinery as hydrogen sulfide, which is a gas at ambient temperature, is highly toxic, which renders the consequences of a leak extremely serious and limits the use thereof. Furthermore, at a higher temperature, hydrogen sulfide itself becomes highly corrosive and will result, in other parts of the refinery, in a worsening of generalized corrosion.

U.S. Pat. No. 5,182,013 discloses, in order to solve this same corrosion problem, the use of other sulfur compounds, namely polysulfides comprising alkyl radicals of 6 to 30 carbon atoms.

More recently, the use of corrosion inhibitors based on sulfur and on phosphorus has also been disclosed.

Thus, patent EP 742 277 discloses the inhibiting effect of a combination of a trialkyl phosphate and of an organic polysulfide. U.S. Pat. No. 5,552,085 recommends the use of thiophosphorus compounds, such as organothiophosphates or organothiophosphites. Patent AU 693 975 discloses, as inhibitor, a mixture of trialkyl phosphate and of phosphoric esters of sulfurized phenol neutralized with calcium hydroxide.

However, organophosphorus compounds are very problematic to handle due to their high toxicity. Furthermore, they are poisons for the hydrotreating catalysts installed for purifying the hydrocarbon fractions resulting from the atmospheric and vacuum distillations. For these two reasons at least, their use in the field of refining is not desirable.

DETAILED DESCRIPTION OF THE INVENTION

Surprisingly, it has now been found that the use of a specific sulfur compound, having both a carboxyl functional group and a mercaptan functional group, makes it possible to inhibit corrosion by naphthenic acids more efficiently than organic polysulfides and without it being necessary to additionally introduce phosphorus inhibitors.

A subject matter of the invention is thus a process for combating the corrosion by naphthenic acids of the metal walls of a refining plant, characterized in that it comprises the addition, to the hydrocarbon stream to be treated by the plant, of an effective amount of a compound of formula:

$$HS—B—COOR \quad (I)$$

in which:

- B represents a saturated divalent hydrocarbon radical which can either be acyclic, in the linear or branched form, or cyclic and which comprises from 1 to 18 carbon atoms, preferably from 1 to 4; and
- R represents a hydrogen atom, or an alkali or alkaline earth metal, or an ammonium group, or an alkyl (linear or branched), cycloalkyl, aryl, alkylaryl or arylalkyl radical, said radical comprising from 1 to 18 carbon atoms, preferably 1 to 10, and optionally one or more heteroatoms.

According to a preferred alternative form, use is made, as compound of formula (I), of thioglycolic acid, of formula $HS—CH_2—COOH$, or of one of its esters, preferably an aliphatic ester.

According to a particularly advantageous embodiment, use is made of 2-ethylhexyl thioglycolate, isooctyl thioglycolate or methyl thioglycolate.

The amount of compound of formula (I) to be added to the hydrocarbon stream to be treated by the refining plant generally corresponds to a concentration (expressed as equivalent weight of sulfur) of said compound with respect to the weight of the hydrocarbon stream which can range from 10 to 5000 ppm, preferably from 50 to 500 ppm. It is possible, while remaining within this concentration range, to set a high content at the beginning of the process according to the invention and then to subsequently reduce this content to a maintenance dose.

The process according to the invention advantageously makes it possible to treat hydrocarbon streams, in particular crude oils, having a TAN of greater than 0.2 and preferably of greater than 2.

The temperature at which the process is carried out corresponds to that at which the reactions for corrosion by naphthenic acids occur and is generally between 200 and 450° C. and more particularly between 250 and 350° C.

The compound of formula (I) can be added to the hydrocarbon stream either at the actual inlet of the plant (simultaneously with the hydrocarbon stream to be treated), for an overall treatment of the corrosion, or in the part of the plant where the corrosion reaction occurs, for a localized treatment. This addition can be carried out by any means known to a person skilled in the art which provides control of the injection flow rate and good dispersion of the additive in the hydrocarbon, for example using a nozzle or a mixer.

The term "metal walls of the refining plant, the corrosion of which can be prevented by the process according to the invention," is understood to mean all the walls capable of being in contact with the acidic hydrocarbon stream to be treated. The term can thus relate equally well to the internal wall proper of plants, such as atmospheric and vacuum distillation towers, as to the surface of the components internal to these, such as their plates or packings, or the components peripheral to these, such as their withdrawal and inlet lines, pumps, preheat furnaces or heat exchangers, provided that these components are brought to a local temperature of between 200 and 450° C.

Mention may be made, as nonlimiting examples of hydrocarbon streams to be treated in accordance with the process according to the invention, of petroleum crude oil, atmospheric distillation residue, gas oil fractions resulting from atmospheric and vacuum distillations, and the vacuum distillate and residue resulting from vacuum distillation.

The following examples are given purely by way of illustration of the invention and should not be interpreted for the purpose of limiting the scope thereof.

In these examples, a corrosion test, the conditions of which are given below, is carried out.

Description of the Corrosion Test:

This test employs an iron powder, which simulates a metal surface, and a mineral oil in which a mixture of naphthenic acids is dissolved, which simulates an acidic crude stream. The characteristics of these reactants are as follows:

white mineral oil having a density of 0.838, powder formed of spherical iron particles having a particle size of −40+70 mesh (i.e., of approximately 212 to 425 μm), mixture of naphthenic acids having from 10 to 18 carbon atoms, a boiling point of between 270 and 324° C. and an average molar mass of 244 g/mol.

The following are introduced into a 150 ml glass reactor equipped with a dropping funnel, a water-cooled reflux condenser, a stirring system and a system for measuring the temperature:

70 ml (i.e., 58.8 g) of the mineral oil, 2 g of the iron powder, 2.8 g of the naphthenic acid mixture.

The initial TAN of the reaction mixture is 10.

These reactants are kept in contact at a temperature of 250° C. for 2 hours under a dry nitrogen atmosphere, in order to prevent oxidation reactions.

At the end of the test, the concentration of iron dissolved in the medium is determined by a conventional method employing the conversion to ash of a sample, taking up the residue in an acidic aqueous solution and quantitatively determining with a plasma torch.

This concentration of dissolved iron (expressed as ppm) is directly proportional to the rate of the corrosion of the iron powder brought about by the mixture of naphthenic acids present in the mineral oil.

EXAMPLES

Example 1 (Comparative)

Reference Test in the Absence of Inhibitor

The preceding test is carried out twice without addition of compound of formula (I).

The results are shown in table I below.

TABLE I

| | Concentration of dissolved iron (ppm) |
|---|---|
| Test 1 | 180 |
| Test 2 | 227 |
| Mean | 203.5 |

Example 2

Tests in the Presence of Derivatives of Thioglycolic Acid

Example 1 is repeated, compounds of formula (I) derived from thioglycolic acid being added to the mineral oil during the charging of the reactor. The content of these derivatives is calculated so as to obtain a corresponding concentration of sulfur of 500 ppm by weight in the mineral oil present in the reactor.

The results collated in the following table II are obtained.

The degree of inhibition of the corrosion brought about by the naphthenic acid mixture has also been shown in this table. This degree is expressed in % and is defined by the formula:

$$\text{inhibition}\,(\%) = \left(1 - \frac{[\text{Iron}]\text{ with inhibitor}}{[\text{Iron}]\text{ without inhibitor}}\right) \times 100$$

in which [Iron] is the concentration of dissolved iron measured with or without inhibitor, the concentration of iron without inhibitor being equal to 203.5 ppm in accordance with example 1.

TABLE II

| Compound of formula (I) | Concentration of dissolved iron (ppm) | Degree of inhibition (%) |
|---|---|---|
| Thioglycolic acid (HS—$CH_2$—COOH) | <0.2 | >99.9 |
| Methyl thioglycolate | 45 | 78 |
| Isooctyl thioglycolate | 9 | 96 |
| 2-Ethylhexyl thioglycolate | 11 | 95 |

Example 3

Test in the Presence of Methyl Mercaptopropionate of Formula HS—$CH_2$—$CH_2$—COOMe Example 2 is repeated, the derivatives of thioglycolic acid being replaced with methyl mercaptopropionate at a content also corresponding to 500 ppm of sulfur in the medium.

At the end of the test, a concentration of iron equal to 118 ppm is measured, i.e. a degree of inhibition of 42%.

What is claimed is

1. A process for combating the corrosion by naphthenic acids of the metal walls of a refining plant, characterized in that it comprises the addition, to a hydrocarbon stream having a TAN of greater than 0.2 to be treated by the refining plant, of an effective amount of a corrosion inhibitor consisting essentially of a compound of formula:

HS—B—COOR (I)

in which:

B represents a saturated divalent hydrocarbon radical which can either be acyclic, in the linear or branched form, or cyclic and which comprises from 1 to 18 carbon atoms; and R represents a hydrogen atom, an alkali or alkaline earth metal, an ammonium group, or an alkyl (linear or branched), cycloalkyl, aryl, alkylaryl or arylalkyl radical, said radical comprising from 1 to 18 carbon atoms and optionally one or more heteroatoms.

2. The process as claimed in claim 1, characterized in that the compound of formula (I), comprises thioglycolic acid or esters thereof.

3. The process as claimed in claim 1, characterized in that said compound of formula (I) comprises 2-ethylhexyl thioglycolate, isooctyl thioglycolate or methyl thioglycolate.

4. The process as claimed in claim 1, characterized in that the amount of compound of formula (I) added corresponds to a concentration, expressed as equivalent weight of sulfur, with respect to the weight of the hydrocarbon stream, ranging from 10 to 5000 ppm.

5. The process as claimed in claim 1, characterized in that it is carried out at a temperature of between 200 and 450° C.

6. The process as claimed in claim 1, characterized in that the hydrocarbon stream to be treated is chosen from a petroleum crude oil, an atmospheric distillation residue, gas oil fractions resulting from atmospheric distillations, gas oil fractions resulting from vacuum distillations, a vacuum distillate or residue resulting from vacuum distillation.

7. The process as claimed in claim 1, characterized in that said divalent hydrocarbon radical comprises 1 to 4 carbon atoms.

8. The process as claimed in claim 1, characterized in that said alkyl (linear or branched), cycloalkyl, aryl, alkylaryl or arylalkyl radical comprising from 1 to 10 carbon atoms.

9. The process as claimed in claim 2, characterized in that said ester of thioglycolic acid comprises an aliphatic ester.

10. The process as claimed in claim 1, characterized in that the amount of compound of formula (I) added corresponds to a concentration, expressed as equivalent weight of sulfur, with respect to the weight of the hydrocarbon stream, ranging from 50 to 500 ppm.

11. The process as claimed in claim 1, characterized in that the hydrocarbon stream to be treated has a TAN of greater than 2.

12. The process as claimed in claim 1 characterized in that it is carried out at a temperature between 250 and 350° C.

* * * * *